US005482478A

United States Patent [19]

Liao

[11] Patent Number: 5,482,478

[45] Date of Patent: Jan. 9, 1996

[54] STRUCTURE AC POWER PLUG

[76] Inventor: Nan W. Liao, 18, Tzu Yu Road, Hsinchu City, Taiwan

[21] Appl. No.: 287,366

[22] Filed: Aug. 8, 1994

[51] Int. Cl.[6] ..... H01R 13/62

[52] U.S. Cl. ..... 439/622; 439/650

[58] Field of Search ..... 439/651, 654, 439/655, 620, 621, 622, 650

[56] References Cited

U.S. PATENT DOCUMENTS

| | | | |
|---|---|---|---|
| 4,679,877 | 7/1987 | Ahroni | 439/622 |
| 4,684,914 | 8/1987 | Wu | 439/622 |
| 4,904,976 | 2/1990 | Liaq | 439/622 |
| 5,154,642 | 10/1992 | Chung-Yin | 439/622 |
| 5,249,986 | 10/1993 | Lu | 439/622 |
| 5,281,943 | 1/1994 | Liao | 439/943 |
| 5,320,563 | 6/1994 | Liao | 439/622 |

*Primary Examiner*—David L. Pirlot

*Attorney, Agent, or Firm*—Morton J. Rosenberg; David I. Klein

[57] ABSTRACT

An improved AC power plug structure is provided. The AC power plug consists of an outer housing, base and conductor structure which utilize differently positioned connection methods. The base and the outer housing are firmly assembled together, while the conductor wires within the base are separately routed so the conductor wires cannot be pulled from their connection with the wire terminals. Further, a pair of special built-in safety fuses are located inside the base.

4 Claims, 25 Drawing Sheets

STRUCTURE AC POWER PLUG

BACKGROUND OF THE INVENTION

Due to the poor design of conventional AC power plugs, the power cord can be pulled and detached from the outer plug housing or pulled and detached from the wire connector terminals. Furthermore, since the design of the plug base is inappropriate, it is troublesome to replace the safety protection fuse and thus subjects the user to inconvenience and danger.

The primary objective of the invention herein is to remedy the aforementioned shortcomings by introducing significant improvements, wherein the base and outer housing assembly method and built-in safety fuse are configured in a new design. Since the assembly fastening section is positioned quite a distance away from the safety fuse, the assembly tightness is not affected by overheating, thereby facilitating maximum user safety and convenience.

The preferred embodiment of the invention herein is illustrated by the following brief descriptions of the drawings and detailed description of the invention herein.

BRIEF DESCRIPTION OF THE DRAWINGS

FIG. 2-1 is another perspective exploded view of the present invention;

FIG. 2-2 is a plan view of a plug of the present invention;

FIGS. 13, 13-1, 13-2, 13-3, 13-4, and 13-5 are perspective views of the base of the present invention showing the relative position of the safety fuse;

FIG. 14-1 is a cross-sectional view of the safety fuse shown in FIG. 14;

FIG. 15-1 is cross-sectional view of the double safety fuses shown in FIG. 15; and, FIG. 15-2 is an end view of the double safety fuses shown in FIG. 15.

DESCRIPTION OF THE PREFERRED EMBODIMENTS

Figure 1:
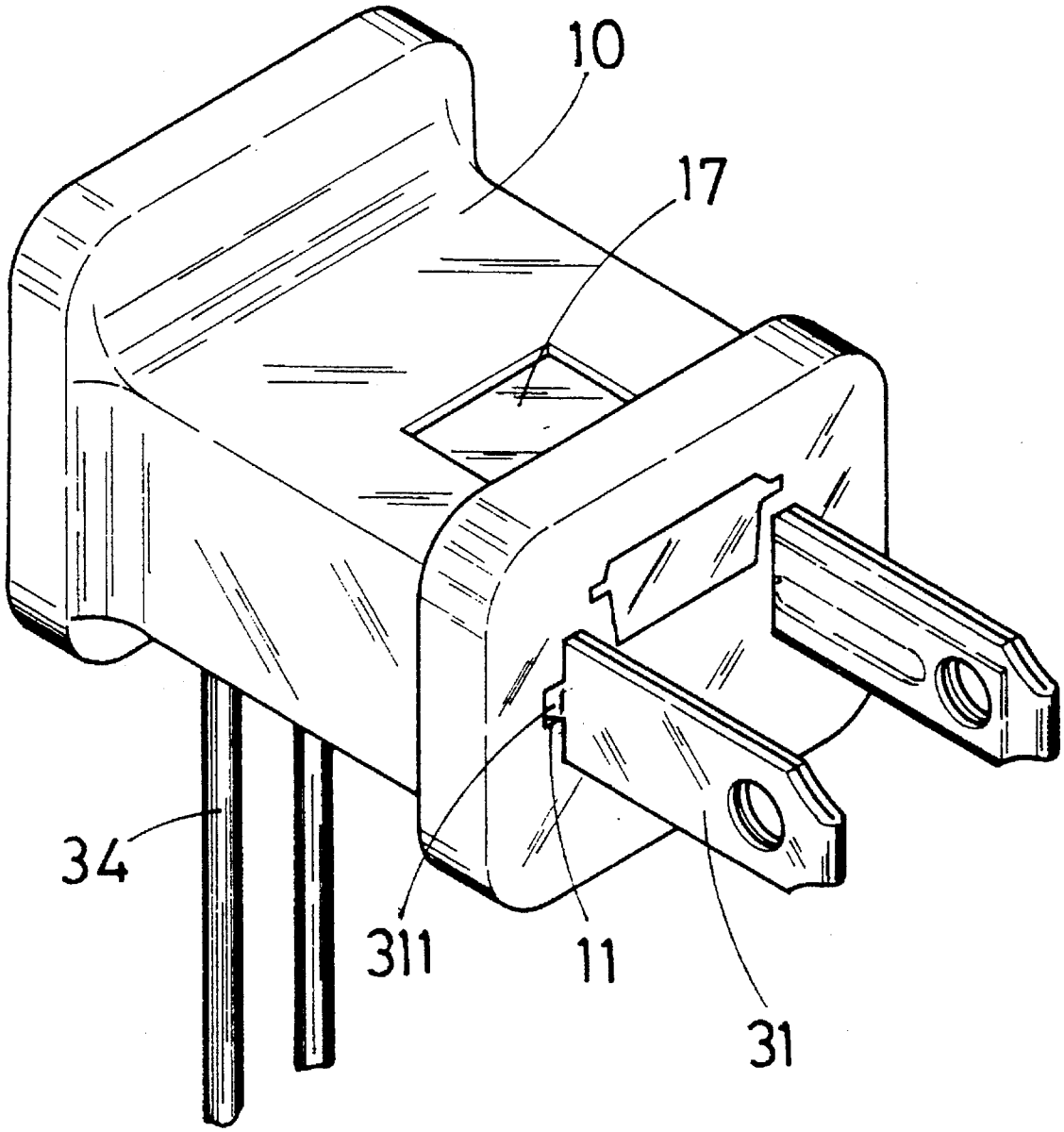
FIG. 1 is a perspective view of the present invention.
Figure 2:
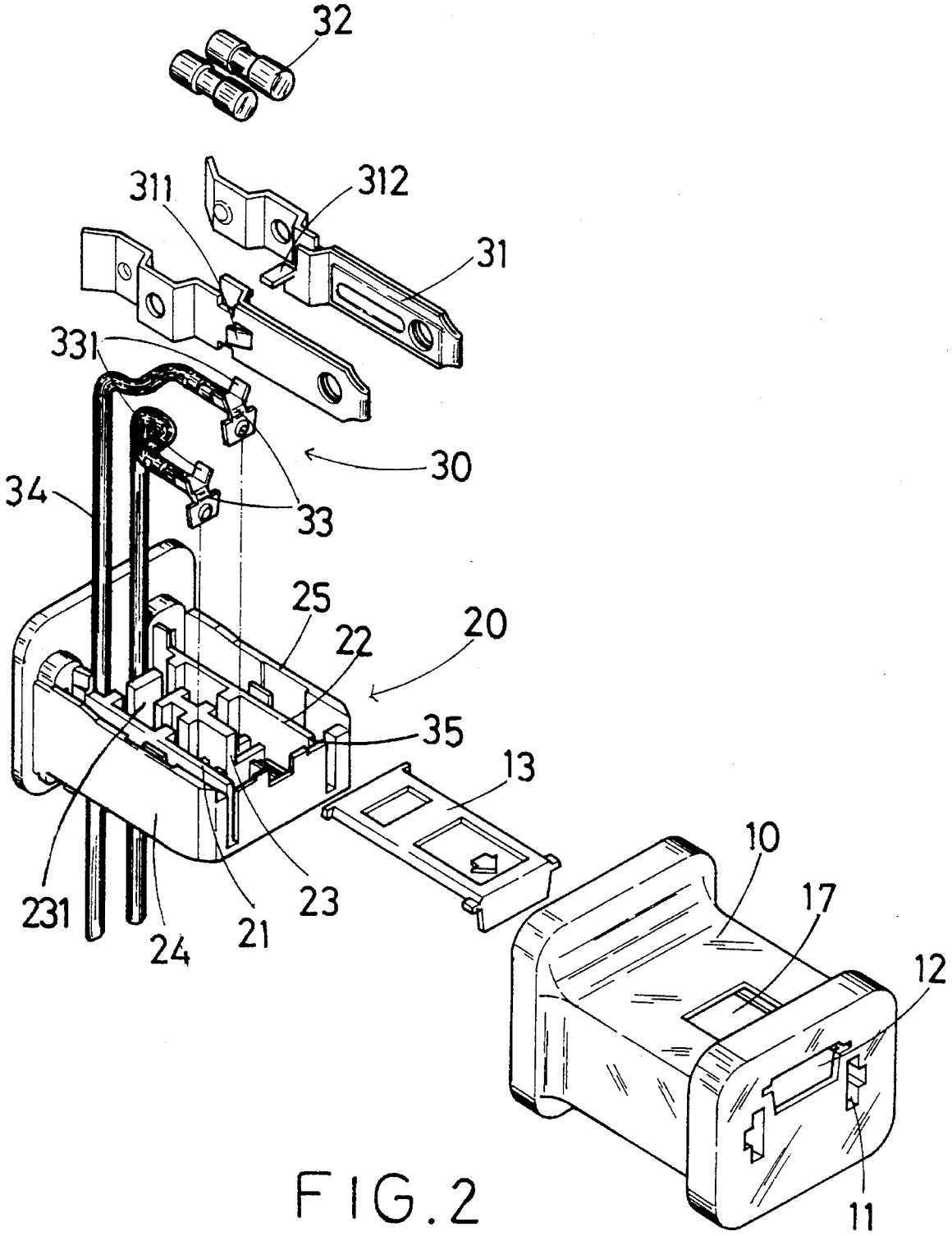
FIG. 2 is a perspective exploded view of the present invention.
Figures 1, 2:
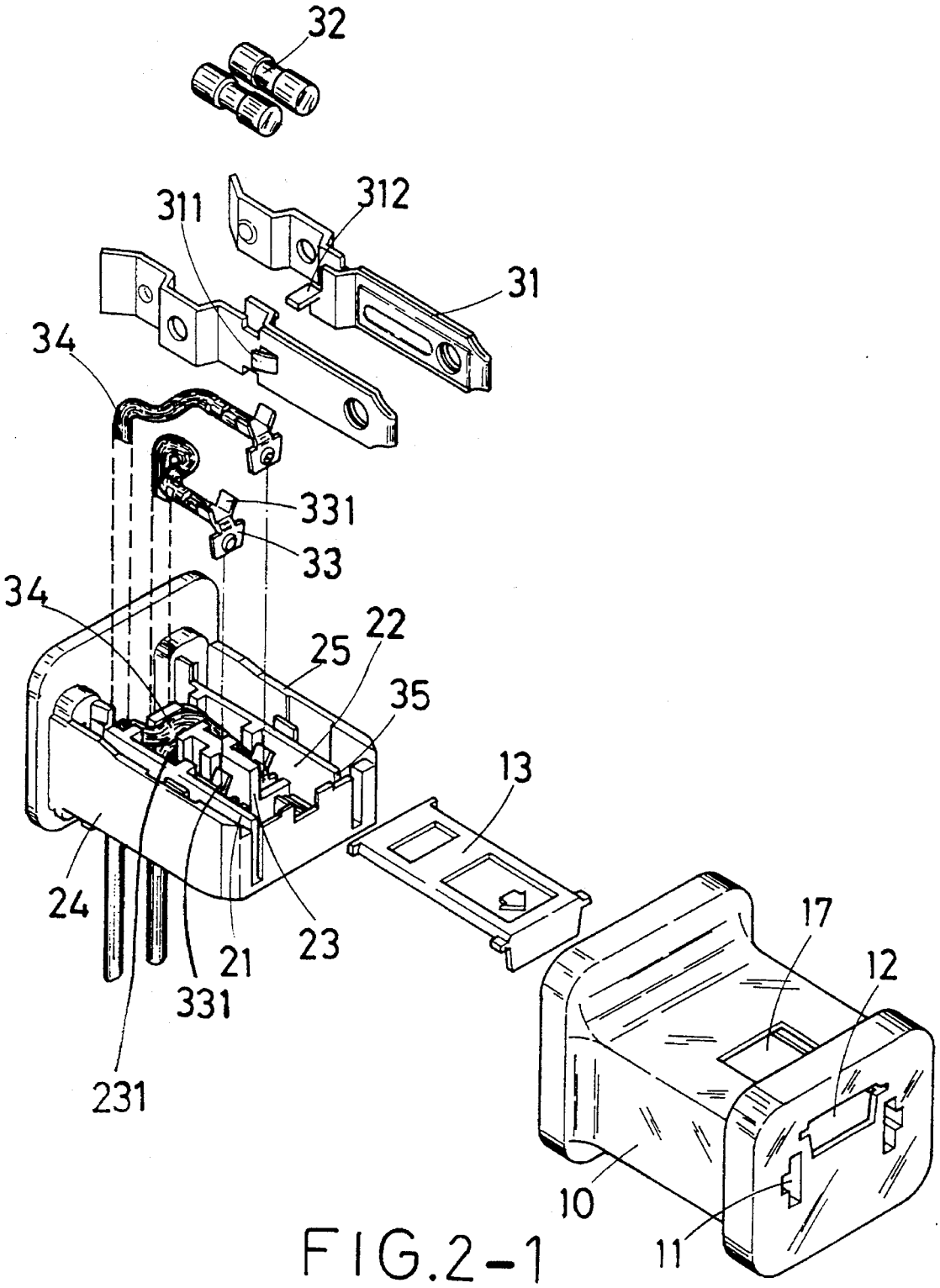
Figure 2:
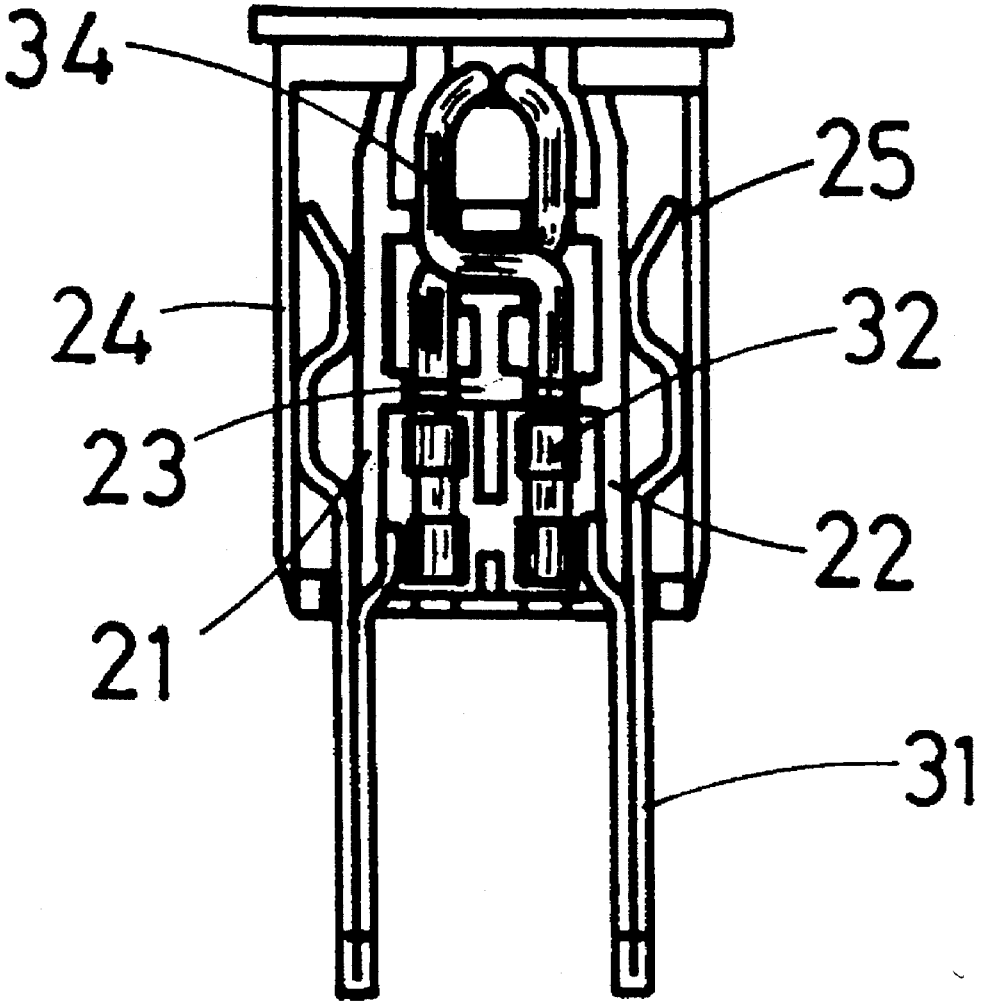
Figure 3:
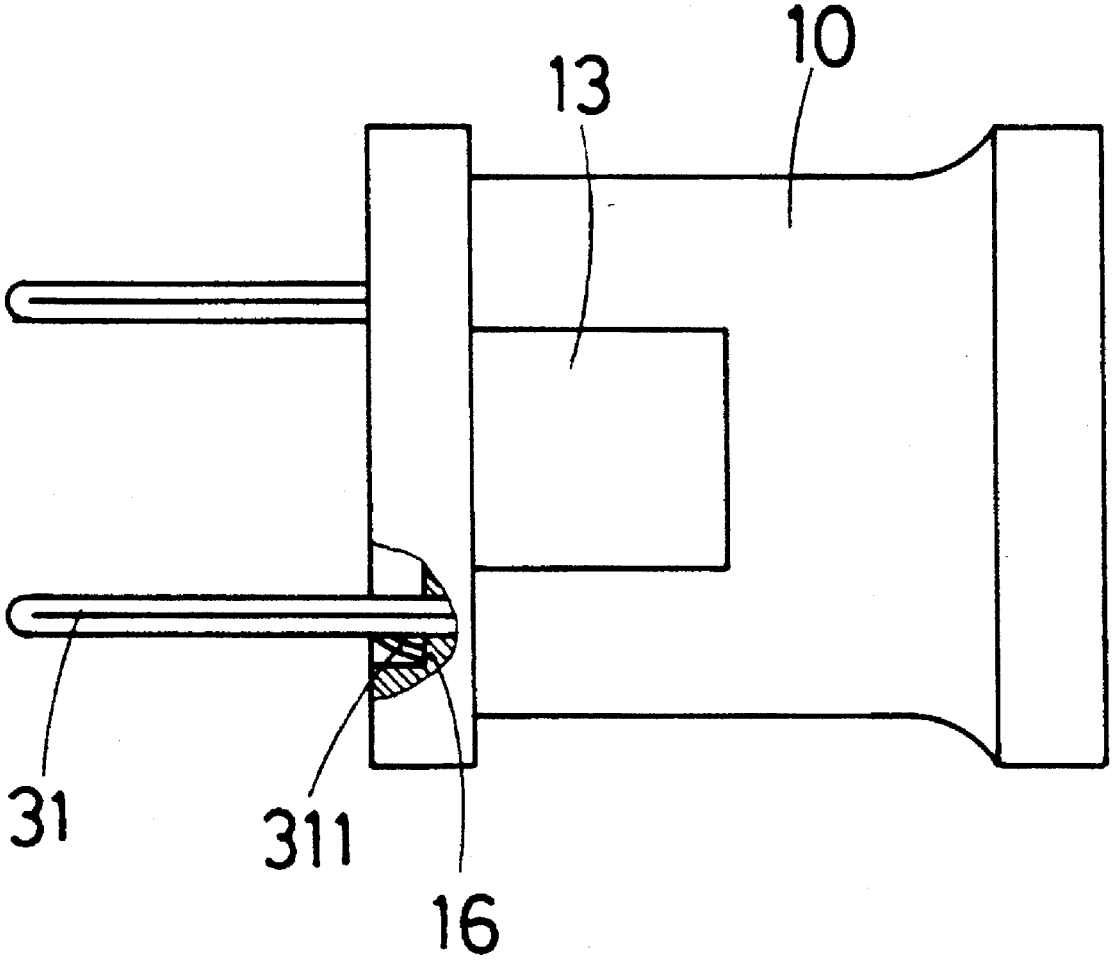
FIG. 3 is an elevation view in partial cross-section of the present invention.
Figure 5:
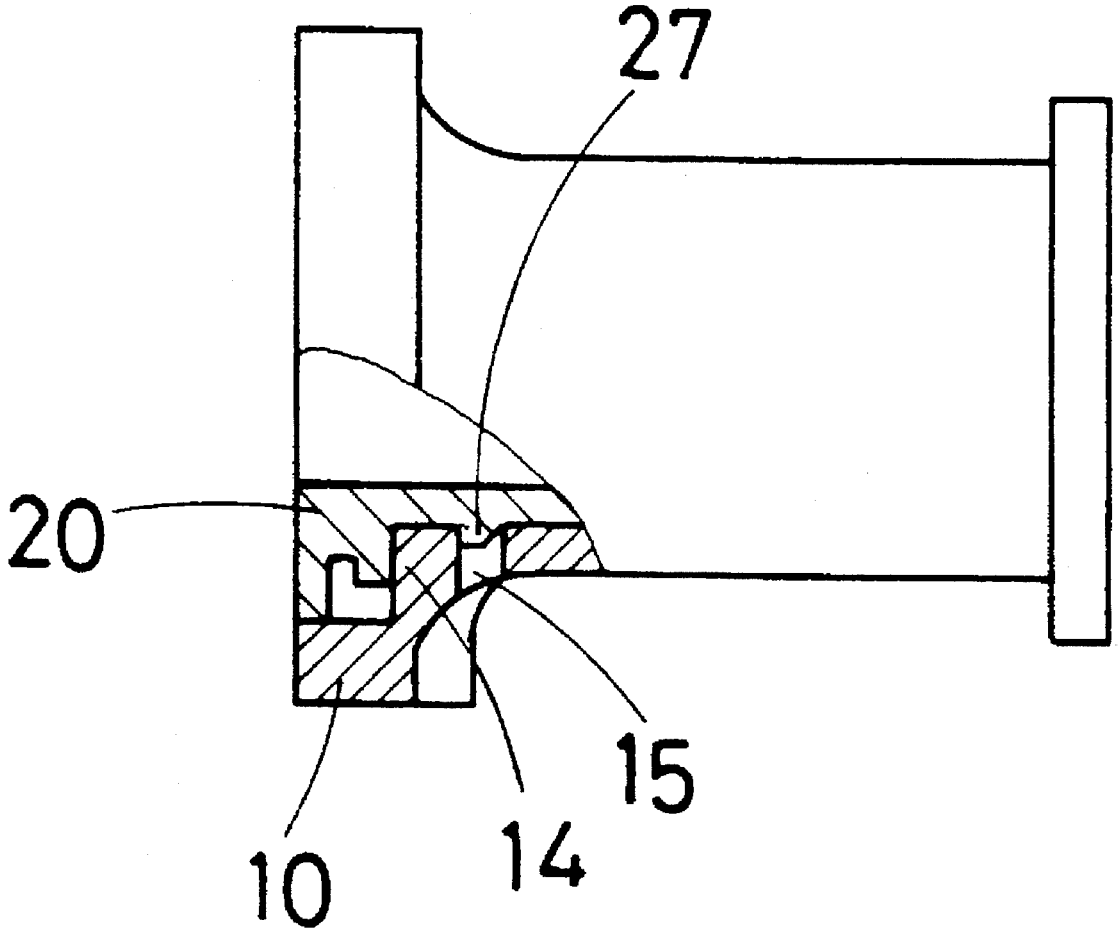
FIG. 5 is a partial cross-sectional view of the interface shown in FIG. 4.
Figure 6:
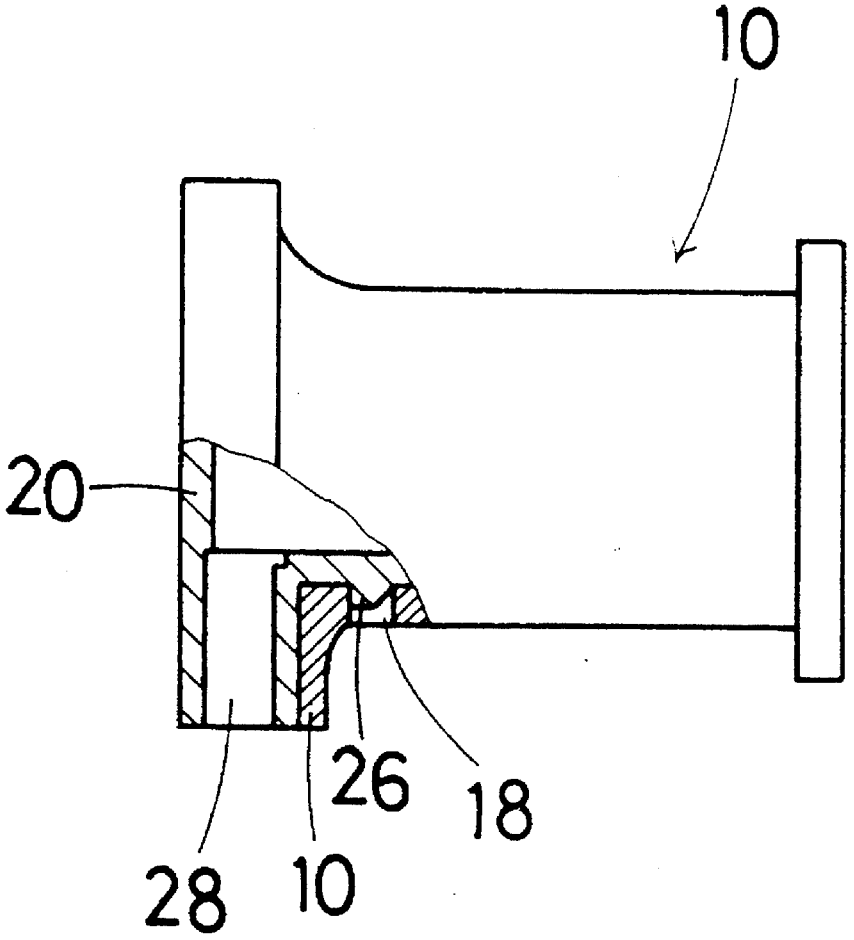
FIG. 6 is another cross-sectional view of the interface shown in FIG. 4.

As indicated in FIGS. 1 and 2, the AC power plug is comprised of an outer housing 10, a base 20 and a conductor assembly 30. As also shown in FIGS. 2-1 and 2-2, it can be seen that there are two T-shaped conductor insertion holes 11 through the front end of the outer housing 10 as well as a safety fuse enclosure cover hole 12 for the insertion of the safety fuse enclosure cover. On the upper surface of the outer housing 10, there is a safety fuse entryway 17. As indicated in FIG. 5 and FIG. 6, the lower inner surface of the outer housing 10 has a protruding edge 14, a slotted center hole 18 and a pair of lateral slots 15. The inside of each of the T-shaped conductor insertion holes 11 has a support 16, as indicated in FIG. 3.

Figure 4:
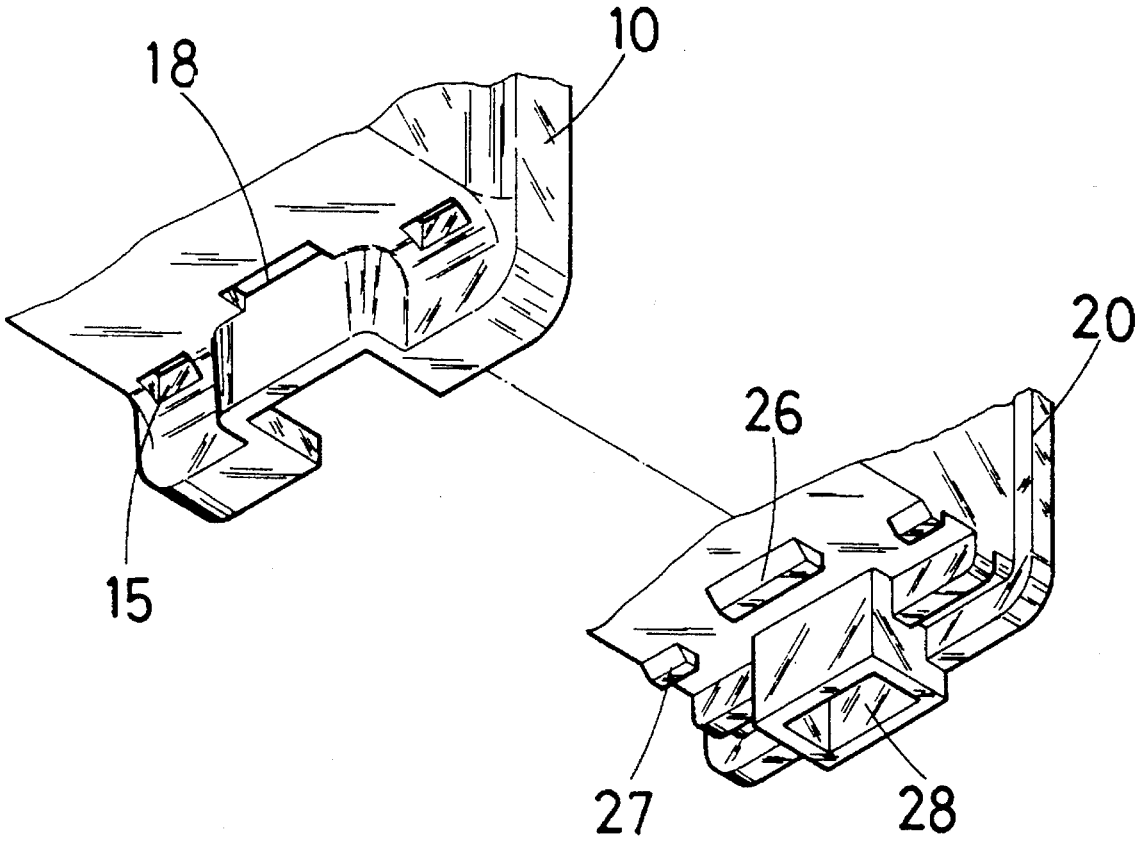
FIG. 4 is a perspective view of the assembly interface between the base and the lower section of the outer housing.

The base 20 is a single unitary structure consisting of an upper section and a lower section, wherein the upper section includes a left barrier plate 21, a right barrier plate 22 and a center partition 23 positioned between the left wall 24 and the right wall 25. Furthermore, there is an opening 231 formed in the rear side of the center partition 23 to create additional internal space and form a strain relief for the wires 33. As indicated in FIGS. 4 to 6, the lower section of the base 20 includes a center tab 26, a pair of spaced lateral tabs 27 and a wire insertion hole 28.

Figure 9:
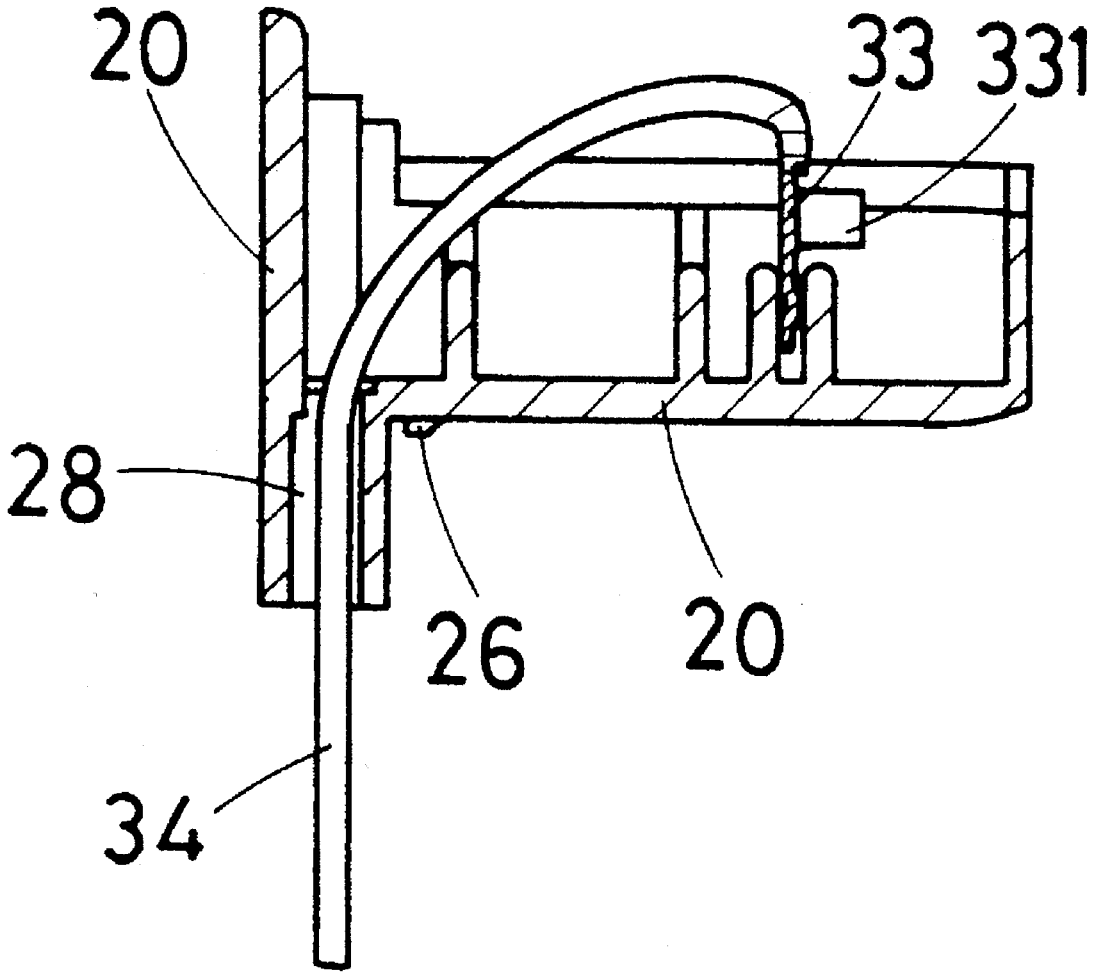
FIG. 9 is a cross-sectional view depicting the wire installation within the conductor connection structure.
Figure 10:
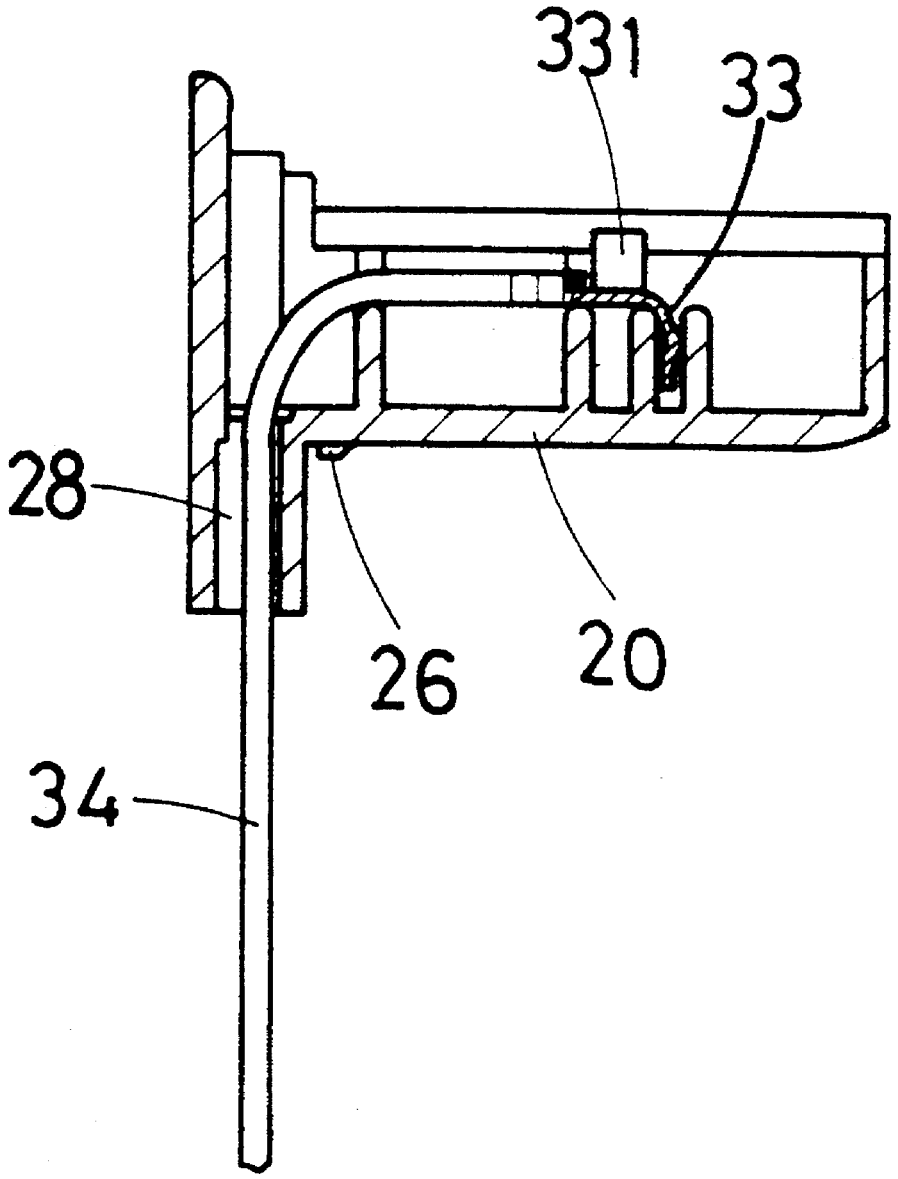
FIG. 10 is a cross-sectional view depicting the wire installation within the conductor connection structure.

The conductor assembly 30 includes two conductor strips 31, two fuses 32, a pair of fuse holders 33 and wires 34. Each of the two conductor strips 31 has a spring-type retaining tab 311 and a conductor tip 312 that fits into the interior sides of the right barrier plate 22 and the left barrier plate 25, respectively. The conductor tips 312 of each conductor strip 31 are inserted through the channel 35 between a respective barrier plate 22, 21 and the front of its base 30, and between a respective barrier plate 22, 21 and the center partition 23. Each wire 34 is permanently connected to a fuse holder 33, each fuse holder 33 has two conductor strips 331. Each fuse holder 33 is first inserted into the entry retainer in the base 20, as indicated in FIG. 9, and rotated 90 degrees, as indicated in FIG. 10. Then, a fuse 32 is placed into the fuse holder 33 between the conductor strips 331 and the conductor tips 312. Subsequent to installation of the second fuse 32, the wires 34 are separated, as indicated in FIGS. 2, 2-1, and 2-2, and routed through the opening 231 in opposing directions, and the wire insertion hole 28.

After the conductor assembly 30 is secured into the base 20, the base 20 and the outer housing 10 are assembled together. Following the insertion of the long conductor strips 31 through the T-shaped conductor insertion holes 11, the spring-type retaining tabs 311 are interlocked onto the support 16, respectively, as indicated in FIG. 3, to complete the first stage of fastening. With respect to the lower section of base 20, as indicated in FIG. 4, FIG. 5 and FIG. 6, in the process of assembling the base 20 to the outer housing 10 the center tab 26 is interlocked into the center slot 18, as indicated in FIG. 6, and the lateral tabs 27 are interlocked into the lateral slots 15, as indicated in FIG. 5 to complete the second stage of fastening.

Figure 7:
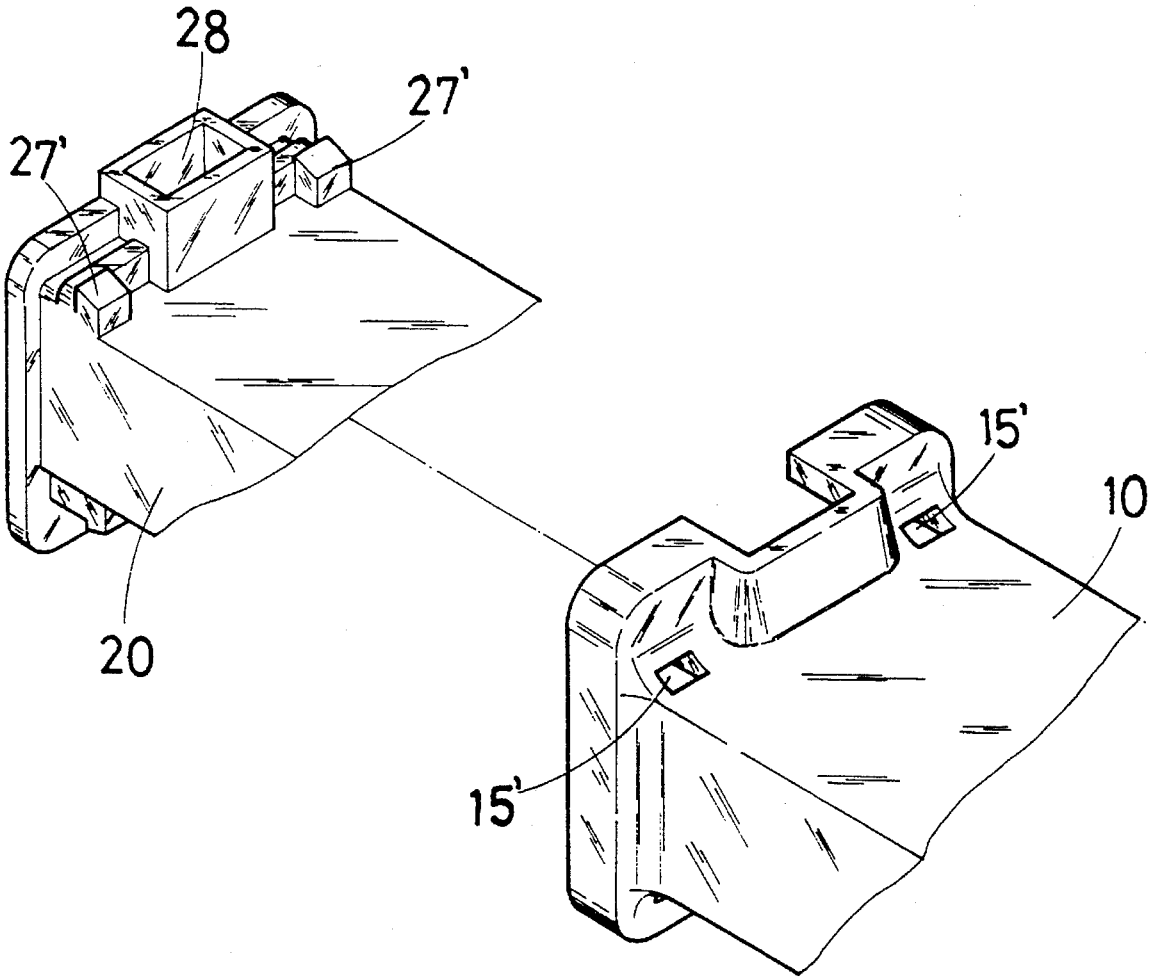
FIG. 7 is another perspective exploded view of the present invention further illustrating the assembly interface between the base and the outer housing.
Figure 8:
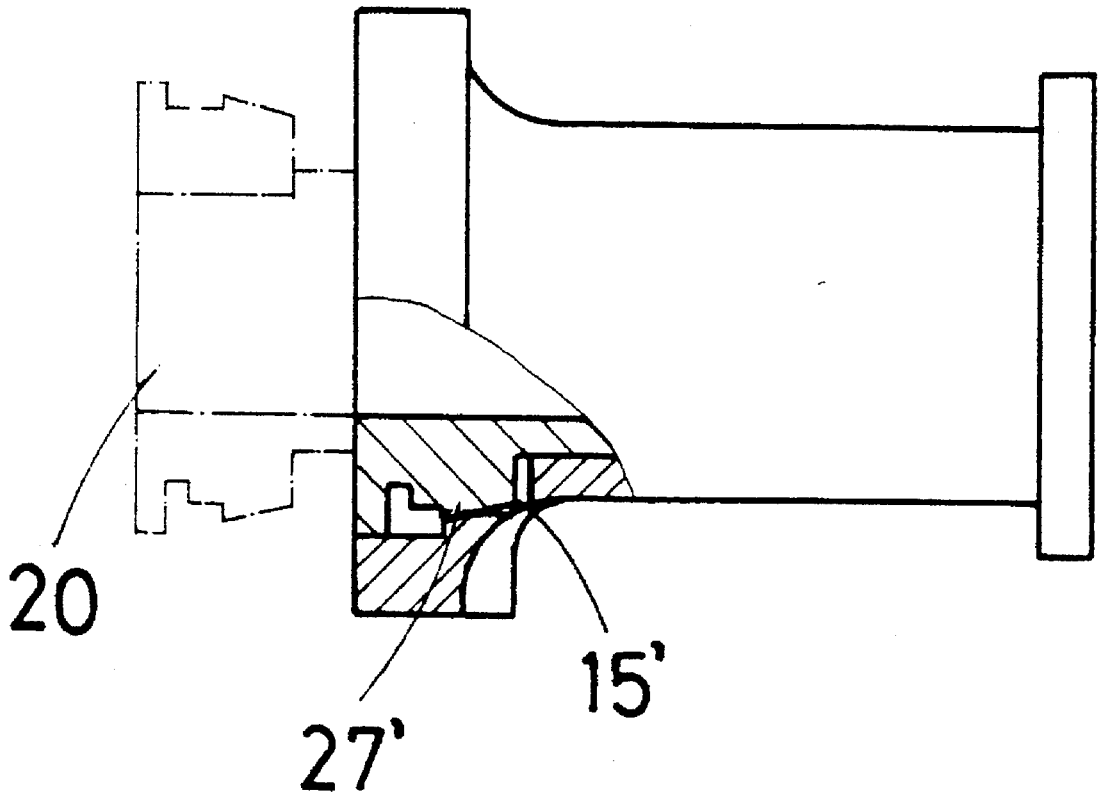
FIG. 8 is a partial cross-sectional view of the interface illustrated in FIG. 7.
Figure 11:
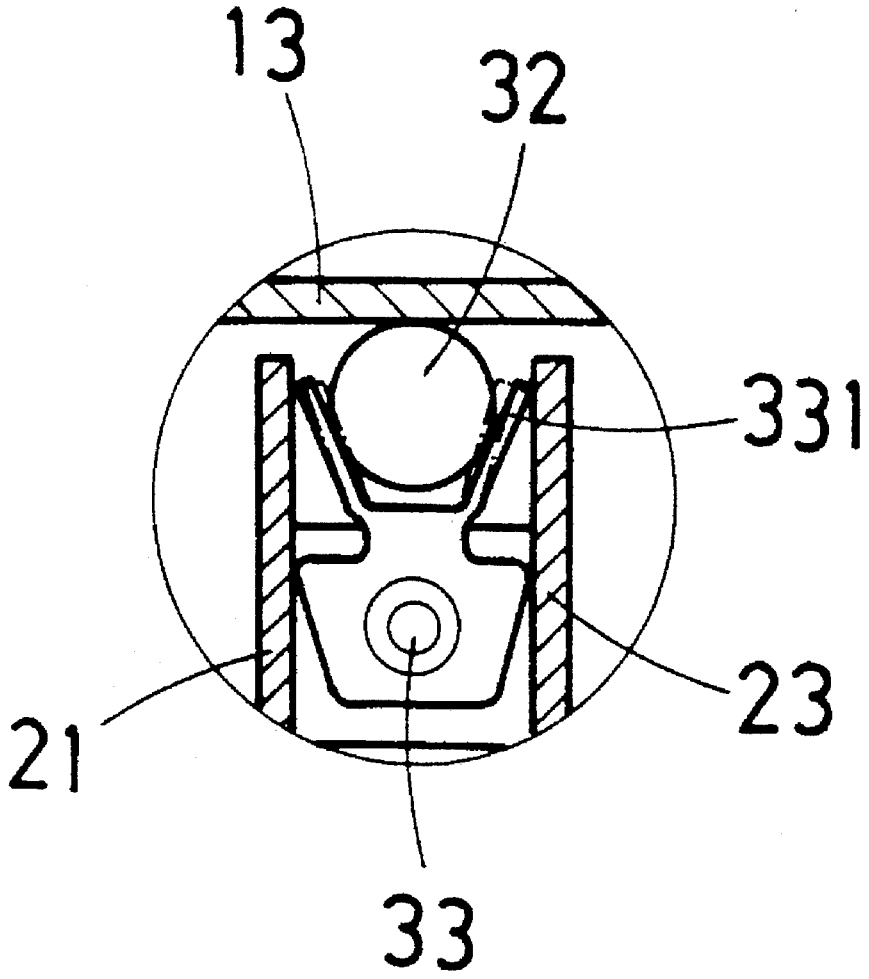
FIG. 11 is a cross-sectional view of the safety fuse section of the conductor structure of the present invention.
Figure 12:
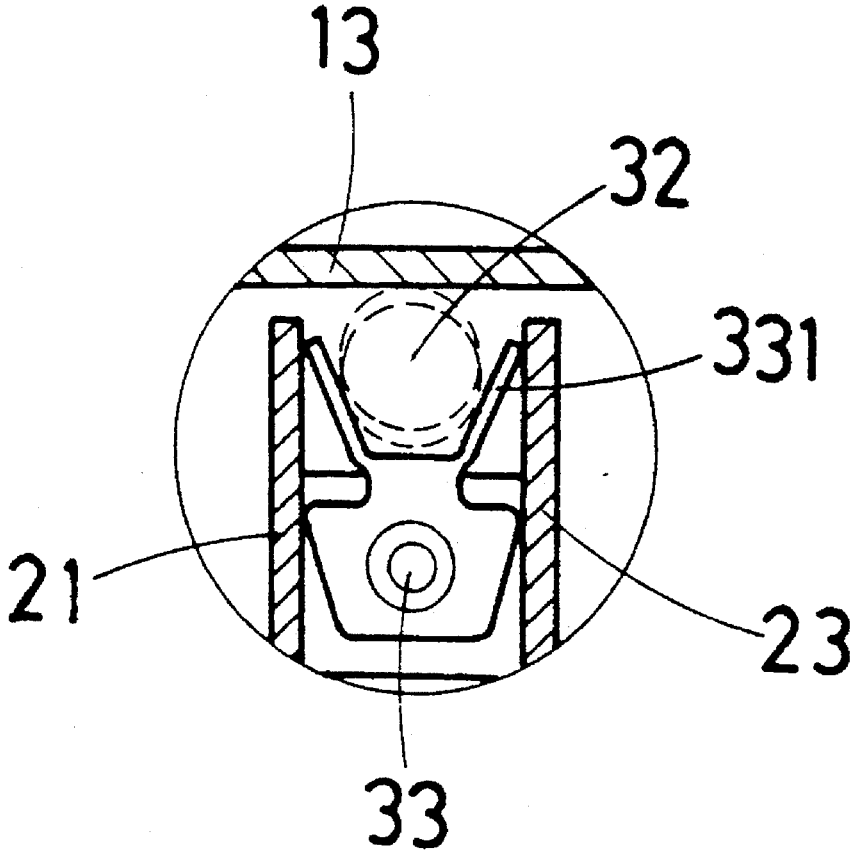
FIG. 12 is a cross-sectional view illustrating the automatic ejection of the safety fuse when the horizontal retaining cover is removed.

The fuses 32 are installed from the safety fuse entryway 17 through the upper surface of the outer housing 10, enabling the fuse enclosure cover 13 to be secured into the safety fuse enclosure cover hole 12. As indicated in FIG. 11 and FIG. 12, each fuse 32 is pressed down by the fuse enclosure cover 13, and the conductor strips 331 are wedged open. However, due to the design of the center partition 23, the maximum opening width of the conductor strips 331 is limited by the distance between the center partition 23 and the respective barrier plate 21, 22 to prevent the conductor strips 331 from losing elasticity over a prolonged period of time and thus unable to maintain sound electrical contact. When the fuse enclosure cover 13 is opened, the tension of the conductor strips 331 is released against the fuses 32, and thereby ejects the fuses 32 for replacement. Another feature of the invention herein is indicated in FIG. 7 and FIG. 8, which are further design enhancements of the structure shown in FIG. 4. Two lateral slots 15' are formed in the outer housing 10, and two lateral tabs 27' are positioned on the base 20. This structure enables the assembly of the outer housing 10 to the base 20 with the lateral tabs 27' being directly interlocked into the lateral slots 15', as indicated in FIG. 8.

Figure 13:
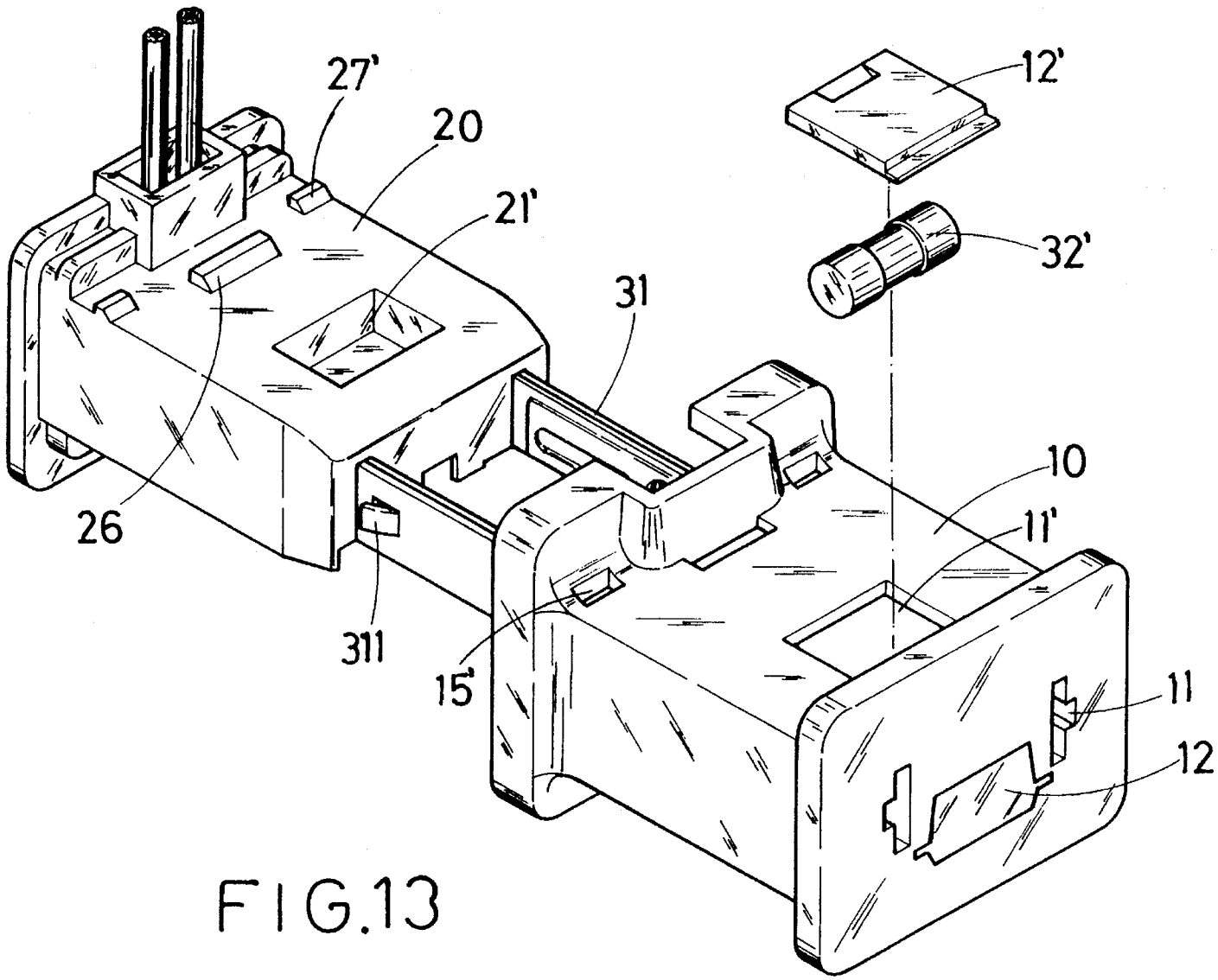
Figures 1, 13:
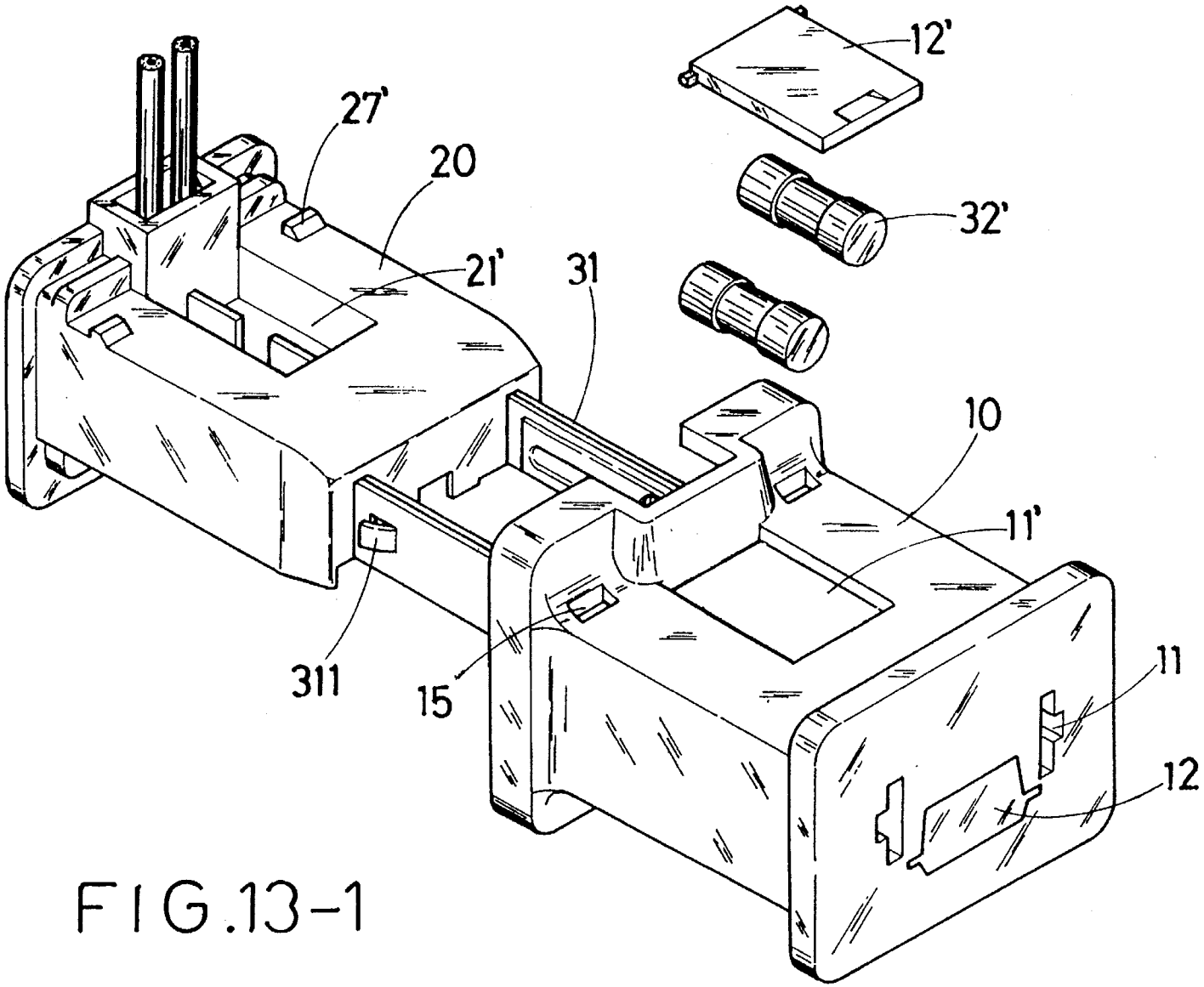
Figures 2, 13:
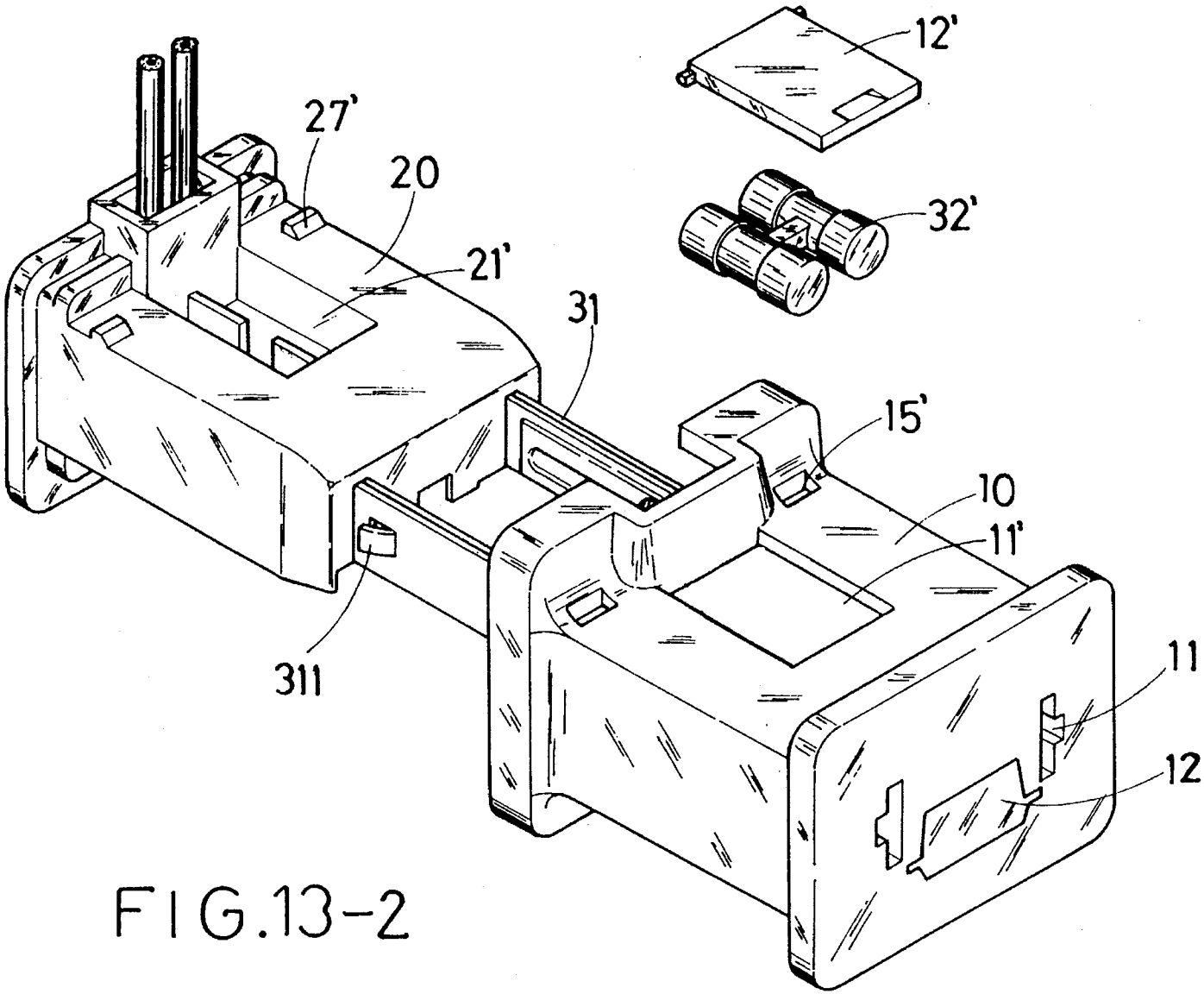
Figures 3, 13:
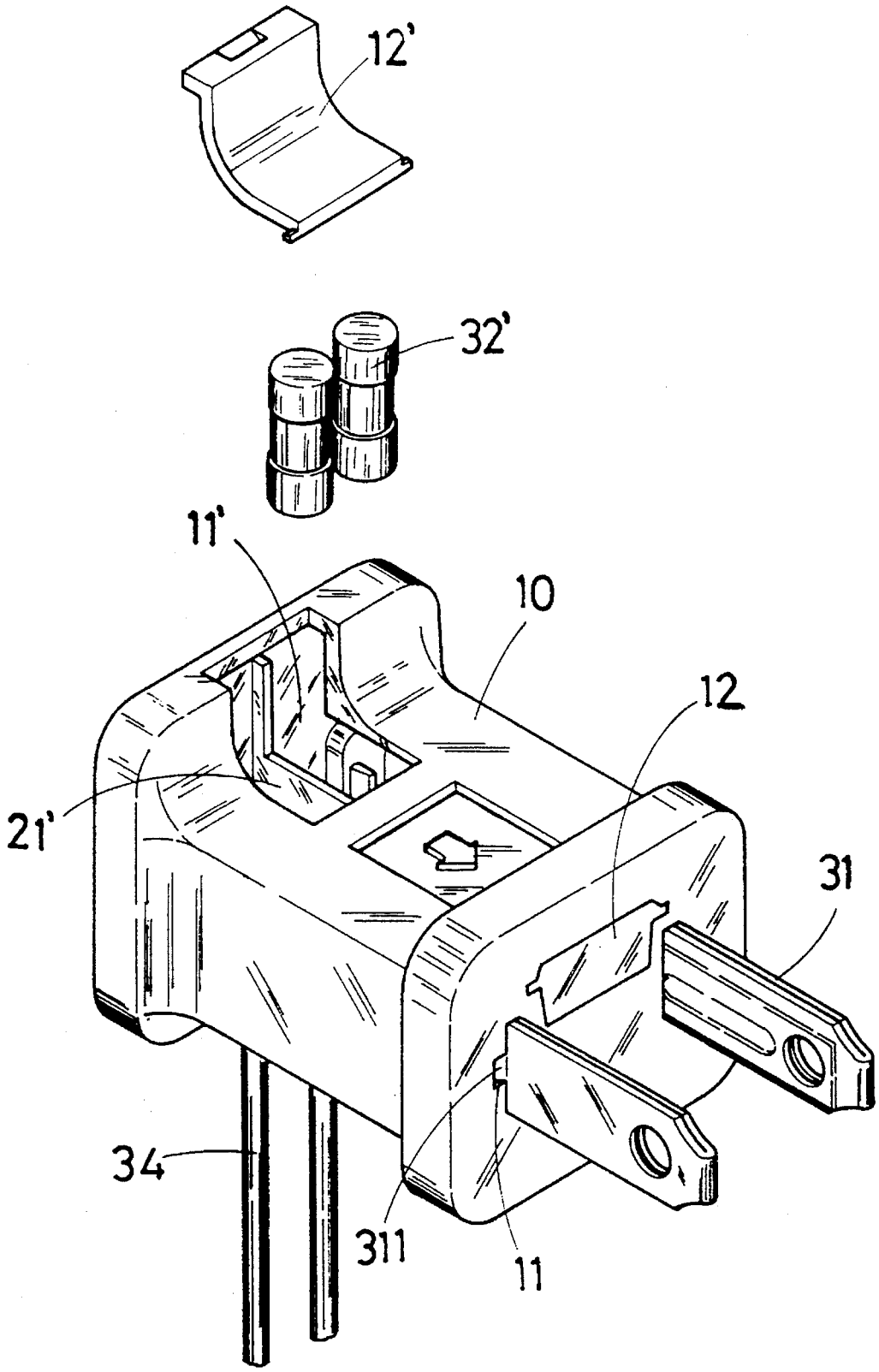
Figures 4, 13:
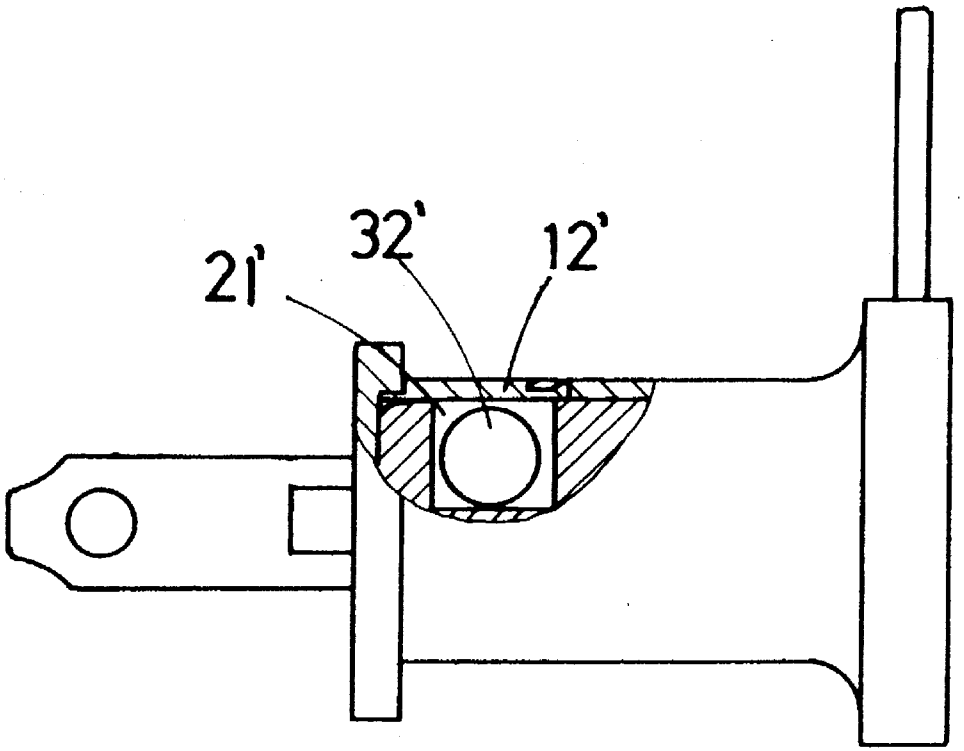
Figures 5, 13:
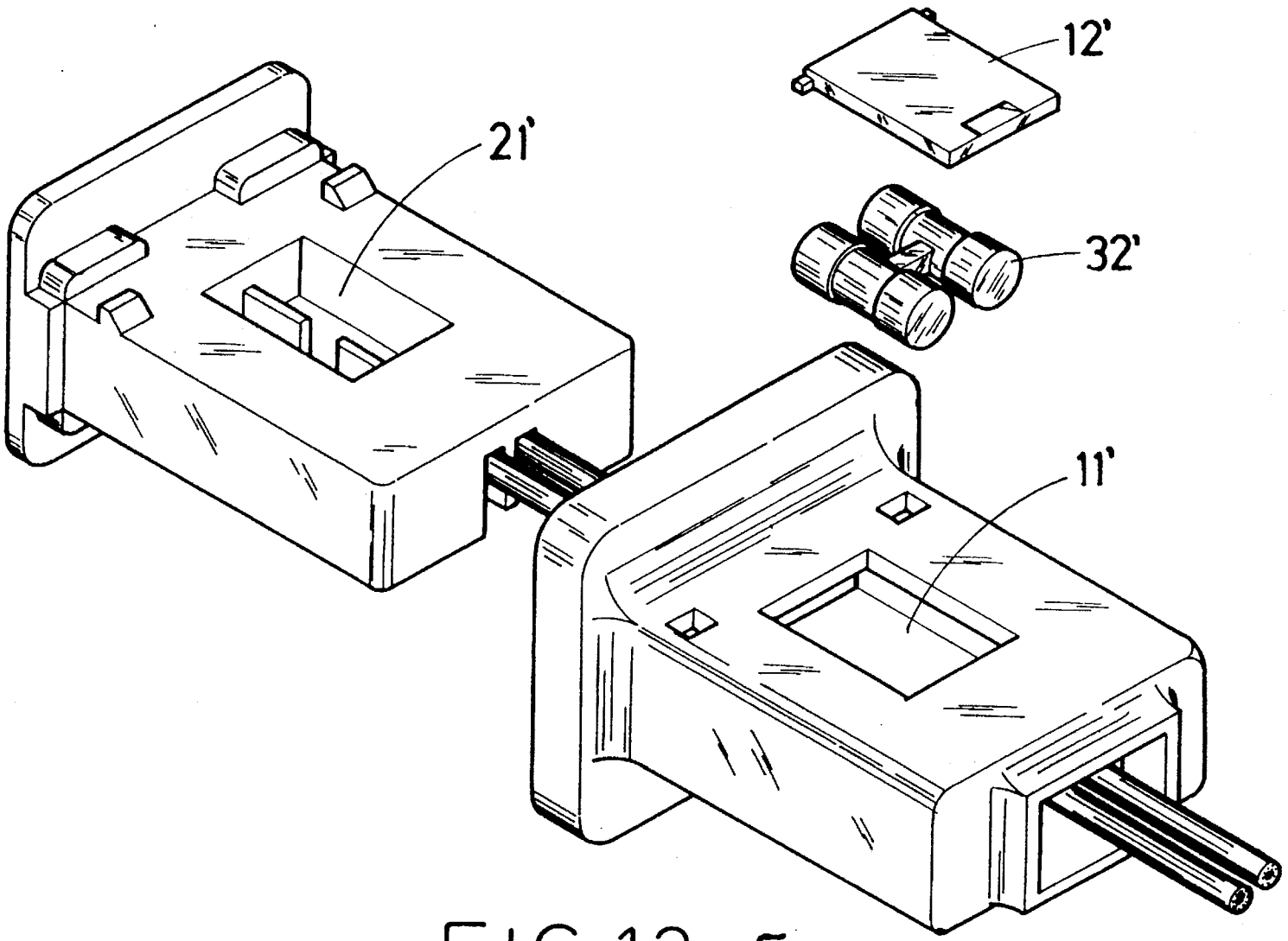
Figure 14:
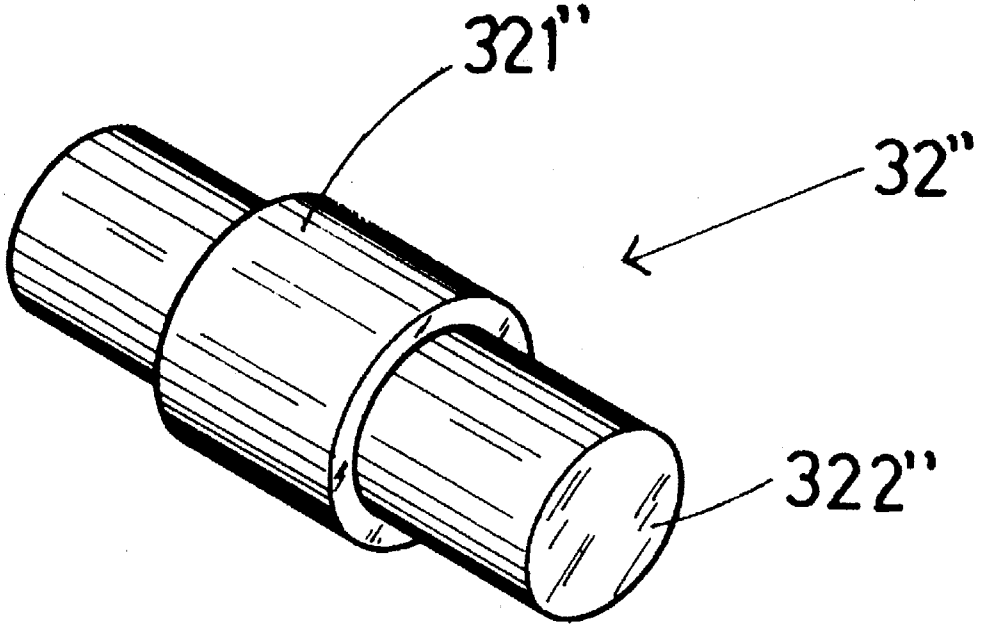
FIG. 14 is a perspective view of a safety fuse utilized in the present invention.
Figures 1, 14:
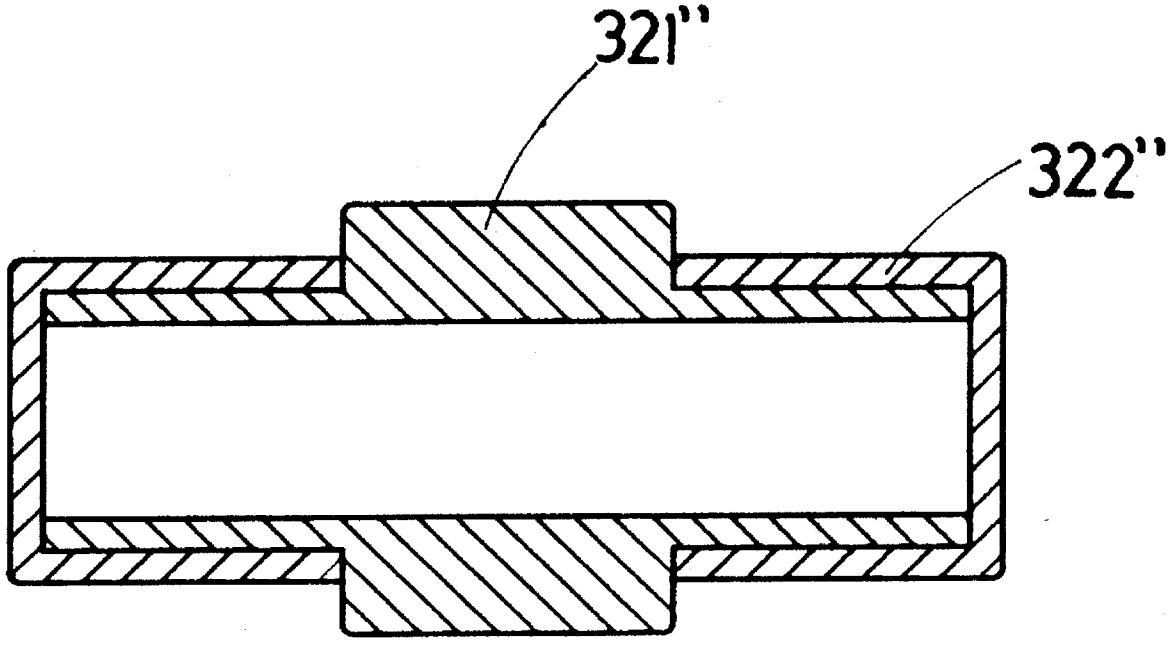
Figure 15:
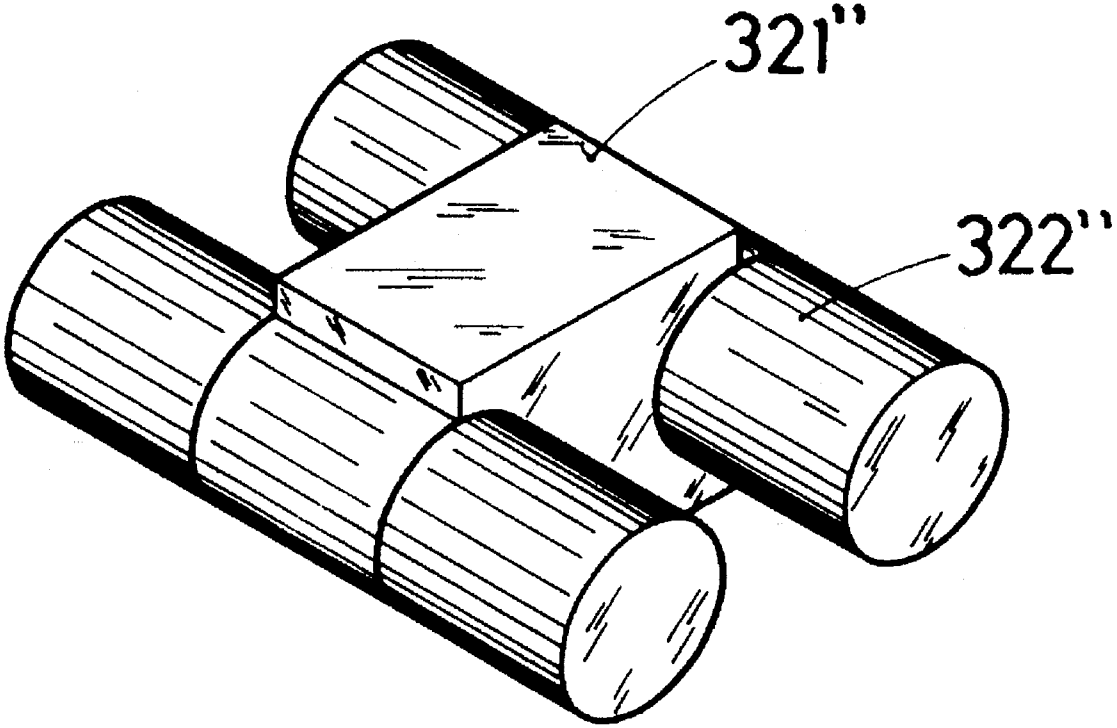
FIG. 15 is a perspective view of the double safety fuses utilized in the present invention.
Figures 1, 15:
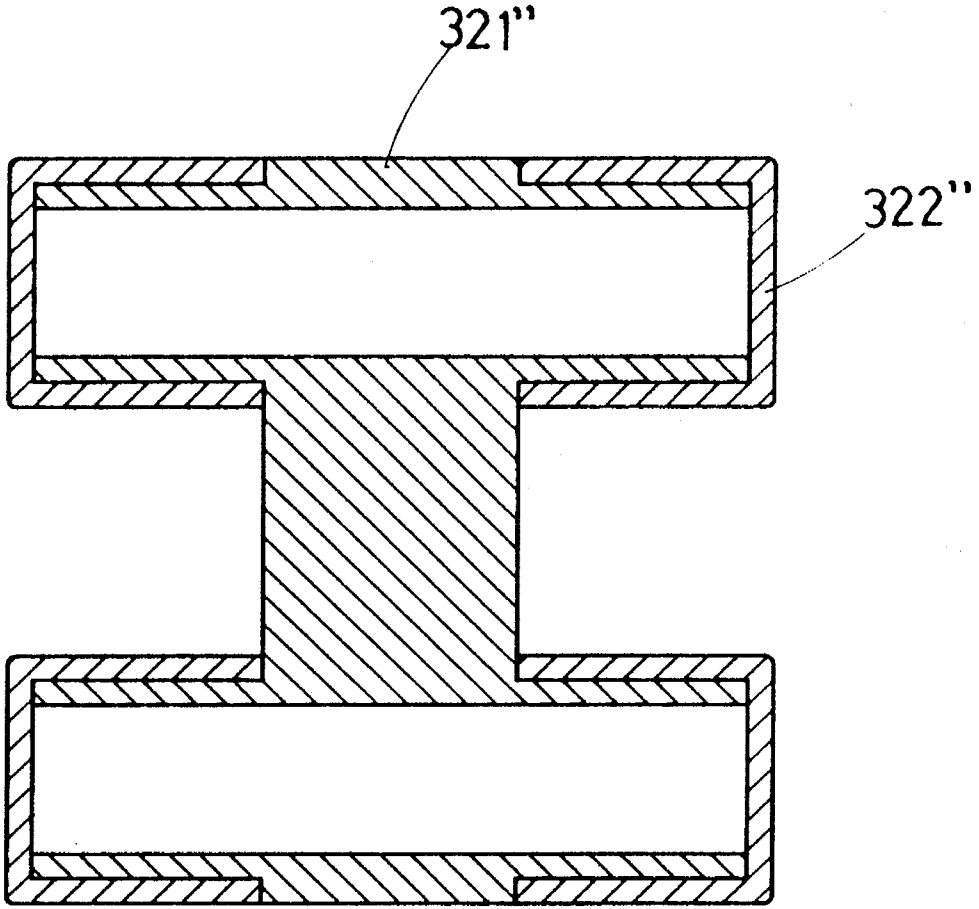
Figures 2, 15:
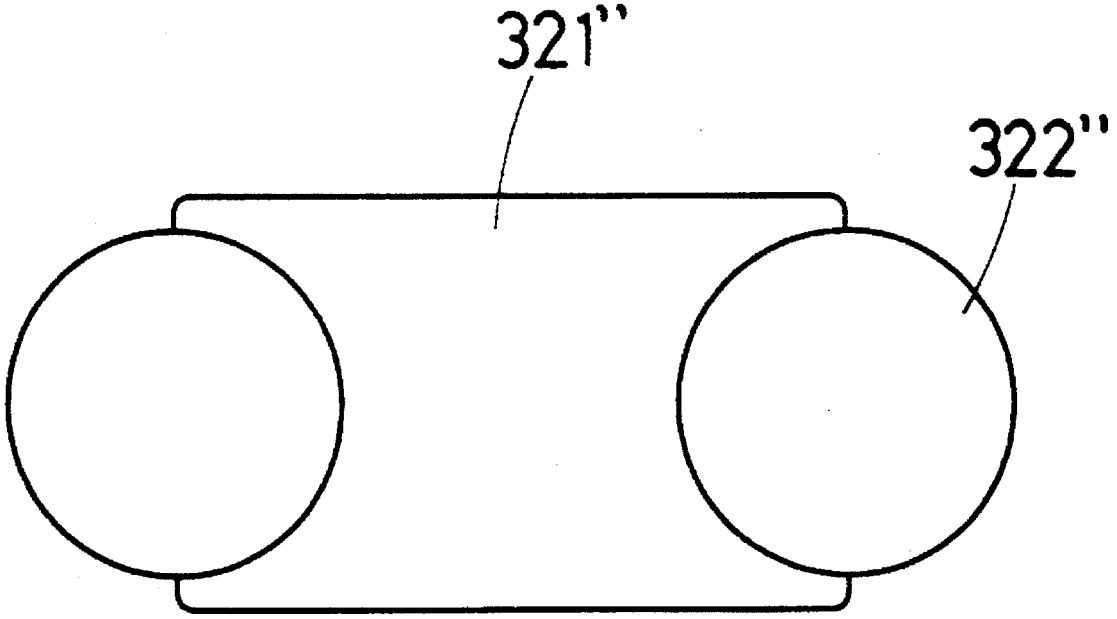

As indicated in FIGS. 13 to 13-5, there are shown some modifications in the fuse access arrangement. As shown, recess 21' can be molded at a suitable location into the underside of the base 20, a corresponding opening 11' formed in outer housing 10, and a cover plate 12' added to the outer housing 10 to enable fuses 32' to be installed into the recess 21', thereby facilitating consumer operating convenience.

As indicated in FIGS. 14, 14-1, 15, 15-1, and 15-2, in order to prevent the metal end contacts 322" from becoming accidentally detached from the main body 321" of the fuses 32" due to the opening and closing of the fuse enclosure cover 13, the main body 321" of the fuse 32" is designed with a protruding section that is of a wider diameter than the metal end contacts 322". This prevents the detachment of the metal end contacts 322" due to the influence of the fuse enclosure cover 13, which may otherwise accidentally cause a situation of poor electrical contact.

In summation of the foregoing description, the disclosed AC power plug has the special characteristics of originality, practicality and enhanced function that enables the inclusion of two safety devices inside the AC plug. The disclosed AC plug has built-in safety protection fuses and provisions for the sturdy interlocking of the base to the outer housing. Furthermore, the safety protection fuses are maintained in a state of safe electrical contact to thereby attain a major increase in function.

What is claimed is:

1. An improved AC power plug, comprising:

an outer housing having a cavity defined by a perimeter wall with upper and lower sides and an end wall, said end wall having a pair of spaced first slotted openings formed therethrough and a centrally disposed second slotted opening formed therethrough, each of said first slotted openings having a support surface formed adjacent thereto, said upper side having an access opening formed therethrough, said lower side having centrally disposed third slotted opening formed therethrough and a pair of spaced apertures disposed on opposing sides of said third slotted opening;

a base for insert into said outer housing cavity; said base having bottom wall with upper and lower opposing surfaces, said upper surface having a pair of longitudinally extended barriers disposed adjacent opposing sides of said base and a longitudinally extended partition disposed between said pair of barriers, each of said barriers defining a respective first recess between said barrier and a respective adjacent side wall of said base and a second recess between said barrier and said partition, said bottom wall having a wire access opening formed therethrough adjacent said rear end of said partition, said lower surface having a pair of spaced first locking tabs disposed adjacent a rear end of said base for respective engagement with said pair of spaced apertures and a second locking tab disposed intermediate said pair of first locking tabs for engagement with said third slotted opening;

a cover member slidably disposed between said base and said outer housing through said second slotted opening for covering said access opening and being slidably displaceable therefrom to uncover said access opening;

a pair of fuses, each of said fuses being disposed in a respective one of said second recesses in alignment with said access opening, each of said fuses having contacts on opposing first and second ends thereof;

a pair of longitudinally extending conductor members, each of said conductor members having opposing inner and outer sides and being disposed within a respective one of said first recesses, each conductor member having a contact tab extending from said inner side thereof for electrical coupling with said contact on said first end of a respective fuse, each of said conductor members having a retaining tab extending from said outer side thereof for locking engagement with said outer housing support surface; and, a pair of fuse holding connectors respectively disposed in said second recesses for coupling to a pair of wires, each of said fuse holding connectors having a pair of diverging conductor strips formed thereon for contacting said contact on said second end of a respective fuse, each of said fuses elastically displacing said diverging conductor strips of a respective one of said fuse holding connectors responsive to downward displacement of said fuses by displacement of said cover member to cover said access opening, said diverging conductor strips of each of said fuse holding connectors ejecting a respective one of said fuses for facilitating fuse replacement responsive to displacement of said cover member from said access opening.

2. The improved AC power plug as recited in claim 1 where each of said barriers and said partition define means to limit displacement of each of said pair of conductor strips responsive to said downward displacement of said fuses.

3. The improved AC power plug as recited in claim 1 where each of said partition has an opening formed transversely therethrough adjacent a rear end thereof to form a strain relief for a pair of wires extending from said pair of fuse holding connectors and crossing over from one of said pair of second recesses to the other for passage through said wire access opening.

4. The improved AC power plug as recited in claim 1 where each of said fuses has a protruding body portion having a diameter larger than a diameter of said fuse contacts, said protruding body portion contacting said cover member.

* * * * *